United States Patent [19]

Katayama et al.

[11] Patent Number: 4,512,552

[45] Date of Patent: Apr. 23, 1985

[54] CORROSION INHIBITOR

[75] Inventors: Sakae Katayama, Osaka; Tadahiko Asano, Sennan; Kazuo Marugame, Sakai; Sadaoki Kanada, Ibaraki; Yoshinari Kawasaki, Osaka, all of Japan

[73] Assignee: Katayama Chemical Works Co., Ltd., Osaka, Japan

[21] Appl. No.: 442,136

[22] Filed: Nov. 16, 1982

[51] Int. Cl.[3] ..... C23F 11/18; C09K 3/00

[52] U.S. Cl. ..... 253/389 R; 252/392; 252/394; 252/181

[58] Field of Search ..... 252/389.51, 389.52, 252/389.53, 389.54, 389.62, 392, 394, 181; 422/16, 17

[56] References Cited

U.S. PATENT DOCUMENTS

| | | | |
|---|---|---|---|
| 3,699,052 | 10/1972 | Petrey, Jr. et al. | 422/16 X |
| 3,885,914 | 5/1975 | Hollingshad et al. | 422/16 |
| 3,891,568 | 6/1975 | Nishio et al. | 422/15 X |
| 4,018,702 | 4/1977 | Boffardi et al. | 252/389.52 |
| 4,089,796 | 5/1978 | Harris et al. | 252/389.52 X |
| 4,113,498 | 9/1978 | Rones et al. | 252/396 X |
| 4,120,655 | 10/1978 | Crambes et al. | 422/17 X |
| 4,126,549 | 11/1978 | Jones et al. | 422/16 X |
| 4,250,042 | 2/1981 | Higgins | 422/16 X |

FOREIGN PATENT DOCUMENTS

| | | | |
|---|---|---|---|
| 1588737 | 4/1970 | France | 252/389.54 |
| 145441 | 12/1976 | Japan | 252/389.54 |
| 110934 | 9/1978 | Japan | 252/389.54 |
| 149836 | 12/1978 | Japan | 252/389.52 |
| 174470 | 10/1982 | Japan | 252/389.54 |

*Primary Examiner*—Ben R. Padgett
*Assistant Examiner*—Matthew A. Thexton
*Attorney, Agent, or Firm*—Hubbell, Cohen, Stiefel & Gross

[57] ABSTRACT

A corrosion inhibitor for ferrous metals comprising four different components of (a) an inorganic acid component (such as molybdate or tungstate), (b) an aliphatic hydroxycarboxylic or aliphatic dicarboxylic acid or its salt (such as citric acid, gluconic acid or succinic acid), (c) an inorganic heavy metal compound (such as zinc chloride or stannous chloride) and (d) a water soluble polymer component having a molecular weight of 500–100,000 (such as acylic homo or copolymer), which is especially advantageous for use in water recycling systems.

10 Claims, No Drawings

CORROSION INHIBITOR

BACKGROUND OF THE INVENTION

1. Field of the Invention

The present invention relates to a composition and a method for using the same for the prevention of corrosion of ferrous metals in machines and equipment for using water in the petroleum industry, chemical industry, paper making industry, iron industry, and other industries.

2. Description of the Prior Art

In view of the worsening supply conditions of industrial water, efforts are being made to save water by recycling. For instance, efforts are being made to reduce water discharges from the water cooling systems and to run boilers without blowdown. Recycling of water, however, involves problems. The recycled water increases in concentration of salts, which leads to the formation of scale and causes corrosion of metals in contact with it. Thus, finding a solution to these problems, by the treatment of the recycled water, is a matter of great importance.

In order to solve the problems, we have proposed a corrosion inhibitor composed of gluconic acid or a salt thereof, a molybdate, and a specific acrylic acid polymer, for highly concentrated recycling water (Japanese Patent Publication No. 43376/1978); a corrosion inhibiting composition of an aliphatic dicarboxylic acid, molybdate and nitrite (Japanese Unexamined Patent Publication No. 62181/1980) and a corrosion inhibitor of an aliphatic dicarboxylic acid and nitrite (Japanese Unexamined Patent Publication No. 62182/1980). A further corrosion inhibiting composition of polymaleic acid, an aliphatic hydroxycarboxylic acid, zinc ion and a triazole was proposed in Japanese Unexamined Patent Publication No. 149836/1978.

SUMMARY OF THE INVENTION

The present invention provides a corrosion inhibitor for ferrous metals such as iron, mild steel, and cast iron in water systems, which can exhibit an excellent effect when added to water, especially highly concentrated recycling water in apparatus such as heat exchangers, coolers, radiators, boilers and so forth.

More particularly, this invention provides a corrosion inhibitor which contains as the active ingredients:

(a) one or more inorganic acid components of molybdic acid or its alkali salt, tungstic acid or its alkali salt, or alkali salt of nitrous acid;

(b) an aliphatic hydroxycarboxylic acid or aliphatic dicarboxylic acid having up to seven carbon atoms or a salt thereof;

(c) an inorganic heavy metal compound which may readily release a heavy metal ion in water; and (d) a water-soluble polymer component having a molecular weight in the range of 500 to 100,000, of a homo- or copolymer of acrylic acid, methacrylic acid or maleic acid; a copolymer of any of said three monomers with another copolymerizable compound having an ethylenic double bond; or a mixture of said homopolymer and copolymer.

The inhibitor of this invention is a non-phosphorous composition and is highly effective for preventing ferrous metal corrosion in highly concentrated water recycling systems or boilers operating at high temperatures of 100°-200° C., coincidently preventng scale formation in such systems.

PREFERRED EMBODIMENTS OF THE INVENTION

The alkali salts of molybdic acid, tungstic acid, and nitrous acid which are used in this invention include, for example, alkali metal salts such as lithium salt, sodium salt, and potassium salt, and ammonium salt. Economically preferable among them are sodium molybdate, ammonium molybdate, sodium tungstate, sodium nitrite, and ammonium nitrite. They may be used in combination.

The aliphatic hydroxycarboxylic acid having a carbon number of 7 or less that is used in this invention acid, tartaric acid, lactic acid, gluconic acid or tartronic acid. The aliphatic dicarboxylic acid having a tronic acid. The aliphatic dicarboxylic acid having the carbon number of 7 or less includes, for example, glutaric acid, adipic acid or succinic acid.

The salts of the above-mentioned carboxylic acids include, for example, alkali metal salts such as lithium, sodium or potassium salt and ammonium salt; and salts with aliphatic amines having 6 or less carbon atoms such as mono, di or tri-alkylamine (e.g., methylamine, ethylamine, propylamine, butylamine, pentylamine, hexylamine, or dimethylamine, diethylamine or dipropylamine, or trimethylamine or triethylamine), cyclic alkylamine (e.g., cyclohexylamine or morpholine), or mono, di or tri-hydroxyalkylamine (e.g., ethanolamine, propanolamine, 3-hydroxy-2-methyl-propylamine, diethanolamine or dipropanolamine).

If the hydroxycarboxylic acids or dicarboxylic acids having a carbon number greater than 7 are used, the resulting corrosion inhibitor decreases in corrosion inhibiting effect and in solubility in water. In addition, if they are used in the form of salt, the resulting corrosion inhibitor causes foaming due to increased surface activity and combines with the compounds that make water hard to form insoluble salts which pass into sludge and scale.

If a salt of the hydroxycarboxylic acid or dicarboxylic acid with an aliphatic amine having 7 or more is used, the resulting corrosion inhibitor will increase in surface activity.

Preferable among the above-mentioned components (b) are gluconic acid, succinic acid, citric acid, malic acid, glutaric acid, and adipic acid, and sodium salts, cyclohexylamine salts, and morpholine salts thereof.

Citric acid, malic acid, and gluconic acid, and sodium salt, ammonium salt, cyclohexylamine salt, and morpholine salt thereof are preferable in the case where an aliphatic hydroxycarboxylic acid is used. Glutaric acid, succinic acid, and adipic acid, and sodium salt, ammonium salt, cyclohexylamine salt, and morpholine salt thereof are preferable in the case where an aliphatic dicarboxylic acid is used.

In the meantime, if an aliphatic monocarboxylic acid or salt thereof (e.g., acetic acid, propionic acid, and salt thereof), which is a homologue of the aliphatic hydroxylcarboxylic acid and dicarboxylic acid, is used, the outstanding corrosion inhibiting effect of this invention cannot be obtained. This suggests that the action on metals differs even among homologous compounds, depending on the functional group contained therein.

Compounds that readily release heavy metal ions in water include, for example, sulfates, chlorides, nitrates, and sulfamates of zinc, manganese, tin, cobalt, nickel, titanium, copper, and lead, and mixtures thereof. Preferable among them are salts of manganese, tin, zinc and nickel. The first two are particularly preferable when the corrosion inhibitor is added to boiler water.

The polymer or copolymer of acrylic acid, methacrylic acid, or maleic acid which is used in this invention is a water-soluble polymer which has a molecular weight of 500 to 100,000, preferably 500 to 20,000. Examples of such polymer or copolymer include homopolymers of acrylic acid, methacrylic acid, or maleic acid or mixtures thereof; and copolymers or terpolymers thereof; copolymers of one of said three monomers and a copolymerizable compound having a ethylenic double bond such as methyl acrylate, ethyl acrylate, methyl methacrylate, ethyl methacrylate, acrylamide, methacrylamide, acrylamide-N-propanesulfonic acid, fumaric acid, itaconic acid, and vinyl alcohol, whose copolymers are composed of at least 20 mol% of any of said three monomers, preferably 50 mol% or more. Preferable among them are acrylic acid homopolymer, methacrylic acid homopolymer, maleic acid homopolymer, acylic acid-methacylic acid copolymer, acrylic acid-maleic acid copolymer, methacrylic acid-maleic acid copolymer, acrylic acid-acrylamide copolymer, acrylic acid-acrylamide-N-propanesulfonic acid copolymer, and acrylic acid-methacrylic acid-methyl acrylate terpolymer.

The above-mentioned homopolymers or copolymers should be soluble in water and have a molecular weight of about 500 to 100,000. Those which have a molecular weight greater than about 100,000 are not preferable, because they tend to flocculate even though soluble in water. From the standpoint of ease of synthesis, an acrylic acid polymer or methacrylic acid polymer having a molecular weight of about 1,000 to 20,000 is preferred and a maleic acid homopolymer having a molecular weight of about 500 to 2,000 is preferred. If the polymer is not readily soluble in water even though it has a molecular weight in the specified range, it may be made soluble by converting the free acid or ester thereof in the polymer molecule into a soluble salt (alkali metal salt, ammonium salt, or amine salt).

The above-mentioned four components are formulated into a liquid formulation or mixed directly into a powdery formulation. The aqueous solution should be neutral to alkaline. If it is acidic, molybdic acid or tungstic acid liberates and condenses, or the nitrous acid decomposes, or the aliphatic hydroxycarboxylic acid oxidizes slowly. Thus, it is desirable to add an alkali such as sodium hydroxide and lower amine to adjust the pH.

The preferred weight ratio that permits the four components to exhibit their synergistic effect is 1:0.2–30:0.1–5:0.1–5, preferably 1:0.5–10:0.1–1.5:0.2–1.6, for (a):(b):(c):(d) by weight. In the case of liquid formulation, the total concentration of the four components is dependent on the solubility and pH of each component. A concentration of 5 to 60 wt% is suitable from the standpoint of stability of the formulation. In addition, the liquid formulation may contain a small quantity of stabilizer and other additives.

The formulation composed of the above-mentioned four components should be added to water in an amount of 1 to 200 ppm, preferably 15 to 100 ppm, in terms of the total quantity of the four components, depending on the water quality and the area that requires corrosion inhibition.

Thus, the present invention also provides the method for the corrosion inhibition of metals by adding the above-mentioned four compounds (a), (b), (c), and (d). Each the active ingredients may be added to water individually in the form of single formulation.

The corrosion inhibitor of this invention is effective for protecting heat exchangers, coolers, radiators, boilers, and the like from water corrosion. It is particularly effective when added to recycled water which contain salts at high concentrations. It protects ferrous metals from corrosion and pitting corrosion and prevents the formation of scale.

It is not completely understood how the four components of this invention act on the metal surface, but it is believed that they form a strong protective coating due to the combined effect of their passivating action, dispersing action, and film forming action, in view of the fact that the effect of the four components is much better than that of any three components.

The invention is now described in detail with reference to the following non-limitative examples.

TEST 1

Corrosion inhibition tests were conducted as follows using corrosion inhibitors composed of the above-mentioned four components in varied quantities.

A mild steel test piece (trade name: SPCC) measuring 30×50×1 mm, suspended by a stainless steel stirring rod, was immersed in one liter of test liquid containing chemicals at predetermined concentrations, contained in a flat bottom beaker enclosed in a circular mantle heater in which water temperature is kept constant by a thermostat. The stirring rod was turned by a motor at a rate of 100 rpm. The tests were carried out for five days with agitation while keeping the water temperature at 50° C. The test water was prepared by concentrating city water (Osaka City) five times. The quality of the test water is shown in Table 1.

TABLE 1

| Item | Value |
|---|---|
| pH | 8.3 |
| Electric conductivity (μs/cm) | 910.2 |
| P alkalinity (ppm) | 0 |
| M alkalinity (ppm) | 71.0 |
| Total hardness (ppm) | 238.8 |
| Chloride ion (ppm) | 94.5 |
| Sulfate ion (ppm) | 172.0 |
| Silica ($SiO_2$) (ppm) | 28.5 |
| Total iron (ppm) | 0.50 |
| Calcium hardness (ppm) | 190.0 |

After the prescribed period of test, the test piece was removed and dried. The weight $M_1$ (mg) was measured. The test piece was then treated according to JIS K-0101. After drying, the weight $M_2$ (mg) was measured. The m.d.d. (mg/day.dm$^2$) was calculated according to the following formula:

$$m.d.d. = (A - M_2)/(B \times C) = D/0.3142 \times 5$$

where:

A: Weight (mg) of test piece before testing,

B: Area (dm$^2$) of test piece,

C: Number of days of test, and

D: Corrosion weight loss.

After completion of the test, 500 ml of the test liquid was filtered using Toyo Filter Paper No. 6 and the weight of the solids was measured after drying at 110° C. for one day. The weight of the substance formed on the test piece was calculated by subtracting $M_2$ from $M_1$. The quantity of scale formed from 1 liter of test liquid is defined by the following formula:

$$\text{Scale (mg/liter)} = P \times 2 + (M_1 - M_2)$$

where P: dry weight of precipitates.

The results obtained in Examples and Comparative Examples are shown in Table 2.

TABLE 2

| | Component (a) (ppm) | Component (b) (ppm) | Component (c) (ppm) | Component (d) (ppm) | Quantity of scale (mg/l) | m.d.d. |
|---|---|---|---|---|---|---|
| Example No. | | | | | | |
| 1 | Sodium molybdate (5) | Sodium gluconate (20) | Zinc chloride (7) | Polymaleic acid (MW: 1000) (8) | 1.3 | 0.5 |
| 2 | Sodium molybdate (10) | Sodium gluconate (20) | Zinc chloride (4) | Polymaleic acid (MW: 1000) (8) | 4.8 | 2.5 |
| 3 | Sodium molybdate (20) | Sodium gluconate (20) | Zinc chloride (2) | Polymaleic acid (MW: 1000) (4) | 3.0 | 2.0 |
| 4 | Sodium molybdate (15) | Citric acid (25) | Zinc sulfate (5) | Sodium Polyacrylate (MW: 8000) (4) | 7.6 | 3.4 |
| 5 | Sodium tungstate (15) | Sodium gluconate (15) | Stannous chloride (5) | Acrylic acid-methacrylic acid copolymer (1:1)* (MW: 4000) (6) | 4.9 | 2.0 |
| 6 | Sodium molybdate (10) | Malic acid (10) | Manganese sulfate (7) | Potassium polymethacrylate (MW: 3500) (4) | 4.5 | 2.2 |
| 7 | Sodium molybdate (10) | Sodium gluconate (10), Malic acid (10) | Zinc chloride (2), manganese sulfate (2) | Sodium polyacrylate (MW: 4000) (6) | 3.0 | 1.8 |
| 8 | Sodium molybdate (5) | Sodium gluconate (10) | Zinc chloride (2) | Sodium polyacrylate (MW: 8000) (4) | 19.5 | 10.5 |
| 9 | Sodium molybdate (10) | Sodium gluconate (20) | Zinc chloride (4) | Sodium polyacrylate (MW: 8000) (8) | 4.5 | 2.2 |
| 10 | Sodium molybdate (20) | Sodium gluconate (40) | Zinc chloride (8) | Sodium polyacrylate (MW: 8000) (16) | 1.1 | 0.5 |
| 11 | Sodium nitrite (30) | Malic acid (15) | Zinc chloride (5) | Polymaleic acid (MW: 1000) (8) | 12.5 | 6.0 |
| 12 | Ammonium molybdate (15) | Sodium gluconate (20) | Nickel chloride (8) | Acrylic acid-acrylamide-N—propanesulfonic acid copolymer (4:1) (MW: 3000) (4) | 7.0 | 3.1 |
| 13 | Sodium molybdate (10) | Sodium gluconate (20) | Zinc chloride (5) | Methacrylic acid-acrylamide copolymer (2:1) (MW: 4000) (6) | 7.3 | 3.6 |
| 14 | Sodium tungstate (10) | Malic acid (20) | Manganese sulfate (2), stannous chloride (3) | Acrylic acid-methyl acrylate copolymer (4:1) (MW: 3500) (4) | 5.9 | 2.4 |
| 15 | Ammonium molybdate (20) | Sodium malate (10) | Stannous chloride (4) | Sodium polyacrylate (MW: 20000) (10) | 13.3 | 5.0 |
| 16 | Sodium molybdate (10) | Glutaric acid di-cyclohexylamine salt (15) | Stannous chloride (3) | Polymaleic acid (MW: 1000) (15) | 5.0 | 4.1 |
| 17 | Sodium molybdate (10) | Sodium succinate (15) | Zinc sulfate (5) | Polyacrylic acid (MW: 1000) (10) | 9.2 | 3.5 |
| Comparative Example No. | | | | | | |
| 1 (Blank) | — | — | — | — | 404 | 215 |
| 2 | Sodium molybdate (20) | Sodium gluconate (20) | Zinc chloride (10) | — | 41.0 | 10.1 |
| 3 | — | Sodium gluconate (30) | Zinc chloride (5) | Polymaleic acid (MW: 1000) (10) | 25.3 | 14.3 |
| 4 | Sodium | — | Zinc | Polymaleic acid | 32.8 | 18.0 |

TABLE 2-continued

| | Component (a) (ppm) | Component (b) (ppm) | Component (c) (ppm) | Component (d) (ppm) | Quantity of scale (mg/l) | m.d.d. |
|---|---|---|---|---|---|---|
| | molybdate (30) | | chloride (5) | (MW: 1000) (10) | | |
| 5 | Sodium molybdate (20) | Sodium gluconate (20) | — | Sodium polyacrylate (MW: 8000) (10) | 11.0 | 20.0 |

Note:
The molecular weight of component (d) is an approximate value obtained by the Ostwald method.
*means molar ratio It is to be noted from Table 2 that the corrosion inhibitors composed of the four components according to this invention are superior to the conventional corrosion inhibitors composed of three components of sodium molybdate, sodium gluconate, and polyacrylate. It is also to be noted that the corrosion inhabitors of this invention decrease the quantity of scale to a great extent.

TEST 2

Several formulations composed of the four components of this invention were prepared as shown in Table 3. Using these formulations, the same tests as in Test 1 were carried out. The results are shown in Table 3.

TABLE 3

| No. | Formulation (wt %) | | Concentration of corrosion inhibitor (ppm) | Quantity of scale (mg/l) | m.d.d. |
|---|---|---|---|---|---|
| 1 | Sodium molybdate | 10% | 100 | 5.7 | 3.3 |
| | Sodium gluconate | 15% | | | |
| | Zinc chloride | 2% | | | |
| | Sodium hydroxide | 1% | | | |
| | Acrylic acid-methacrylic acid copolymer (1:1) (MW: 4000) | 3% | | | |
| | Water | 69% | | | |
| 2 | Sodium tungstate | 3% | 100 | 5.8 | 4.0 |
| | Sodium gluconate | 20% | | | |
| | Stannous chloride | 3% | | | |
| | Sodium hydroxide | 0.5% | | | |
| | Acrylic acid-methacrylic acid-methyl acrylate terpolymer (2:2:1) (MW: 4500) | 3% | | | |
| | Water | 70.5% | | | |
| 3 | Sodium molybdate | 10% | 100 | 5.7 | 3.5 |
| | Sodium gluconate | 10% | | | |
| | Sodium citrate | 5% | | | |
| | Sodium hydroxide | 1% | | | |
| | Zinc chloride | 1% | | | |
| | Polyacrylic acid (MW: 8000) | 4% | | | |
| | Water | 69% | | | |
| 4 | Sodium molybdate | 5% | 100 | 6.3 | 3.5 |
| | Dimorpholine salt of adipic acid | 5% | | | |

TABLE 3-continued

| No. | Formulation (wt %) | | Concentration of corrosion inhibitor (ppm) | Quantity of scale (mg/l) | m.d.d. |
|---|---|---|---|---|---|
| | Morpholine salt of gluconic acid | 15% | | | |
| | Stannous chloride | 3% | | | |
| | Acrylic acid-maleic acid copolymer | 3% | | | |
| | Water | 69% | | | |

TEST 3

The following tests were conducted for medium- and low-pressure boilers. The SPCC test piece as used in Test 1 was attached to an apparatus which rotates the test piece at 100 rpm in an autoclave containing 800 ml of test water. The test piece was subjected to corrosion at 200° C. under a pressure of 16 kg/cm$^2$ for 2 days. For accelerated corrosion, the test water was prepared by concentrating city water (Osaka City) 20 times and adjusting to pH 9. A prescribed quantity of the corrosion inhibitor was added to the test water and the test piece suspended by the stirring rod was immersed in the test water.

The corrosion weight loss of the test pieces was measured, and the number of pittings was counted. The quality of the test water is shown in Table 4 and the results are shown in Table 5.

TABLE 4

| Item | Value |
|---|---|
| pH | 9.0 |
| Electric conductivity (μs/cm) | 3750 |
| P alkalinity (ppm) | 85 |
| M alkalinity (ppm) | 470 |
| Total hardness (ppm) | 0 |
| Chloride ion (ppm) | 530 |
| Sulfate ion (ppm) | 520 |
| Silica (ppm) | 144.0 |
| Total iron (ppm) | 0.1 |

TABLE 5

| Example No. | Component (a) (ppm) | Component (b) (ppm) | Component (c) (ppm) | Component (d) (ppm) | Corrosion weight loss (mg) | Number of pits |
|---|---|---|---|---|---|---|
| Blank | — | — | — | — | 213.2 | Countless |
| 1 | Sodium molybdate (5) | Sodium gluconate (50) | Manganese sulfate (5) | Acrylic acid-methacrylic acid copolymer (1:1) (MW: 4000) (3) | 11.2 | 0 |
| 2 | Sodium tungstate (5) | Sodium gluconate (50) | Stannous chloride (5) | Acrylic acid-methyl acrylate copolymer (4:1) (MW: 3500) (3) | 4.7 | 0 |
| 3 | Sodium | Sodium | Manganese | Acrylic acid- | 5.9 | 0 |

TABLE 5-continued

| Example No. | Component (a) (ppm) | Component (b) (ppm) | Component (c) (ppm) | Component (d) (ppm) | Corrosion weight loss (mg) | Number of pits |
|---|---|---|---|---|---|---|
| | molybdate (10) | citrate (20) | sulfate (10) | maleic acid copolymer (2:1) (MW: 4000) (10) | | |
| 4 | Sodium molybdate (5) | Sodium gluconate (50) | Stannous chloride (5) | Polymaleic acid (MW: 1000) (4) | 3.5 | 0 |
| 5 | Sodium tungstate (10) | Sodium gluconate (20) | Stannous chloride (10) | Sodium polyacrylic acid (MW: 8000) (3) | 15.4 | 0 |
| 6 | Sodium molybdate (10) | Gluconic acid (20) | Manganese sulfate (10) | Acrylic acid-methacrylic acid copolymer (1:1) (MW: 4000) (3) | 8.8 | 0 |
| 7 | Sodium molybdate (2) | Cyclohexylamine salt of gluconic acid (55) | Stannous chloride (3) | Polyacrylic acid (MW: 8000) (3) | 3.2 | 0 |

NOTE:
The molecular weight of component (d) in Tables 3 and 5 is an approximate value obtained by the Oswald method.

It is to be noted from the above results that the corrosion inhibitor of this invention is also effective to prevent pitting. Especially the corrosion inhibitor containing tin or manganese ions of this invention is effective for corrosion prevention of boilers.

We claim:

1. A composition comprising:
(a) one or more inorganic acid components of molybdic acid or its alkali salt, tungstic acid or its alkali salt, or the alkali salt of nitrous acid;
(b) an aliphatic hydroxycarboxylic acid or aliphatic dicarboxylic acid having up to seven carbon atoms or salt thereof;
(c) an inorganic heavy metal compound selected from the group consisting of the sulfate, the chloride, the nitrate and the sulfanate of zinc, manganese, tin, and, nickel, and mixtures thereof, which can readily release a heavy metal ion in water; and
(d) a water-soluble polymer component having a molecular weight in the range of 500 to 100,000 of a homo- or co-polymer of acrylic acid, methacrylic acid or maleic acid; or a copolymer of any said three monomers with other copolymerizable compounds having an ethylenic double bond; or a mixture of said homocopolymer and copolymer; the weight ratio of components a:b:c:d: being about 1:0.2–30:0.1–5:0.1–5.

2. The composition as claimed in claim 1, wherein the alkali salt of molybdic acid, tungstic acid or nitrous acid is the lithium, sodium potassium or ammonium salt thereof.

3. The composition as claimed in claim 1, wherein the salt of the aliphatic hydroxycarboxylic acid or aliphatic dicarboxylic acid is the alkali metal salt or salt with an aliphatic amine having 6 or less carbon atoms.

4. The composition as claimed in claim 3, wherein the aliphatic amine is mono, di or tri-alkylamine.

5. The composition as claimed in claim 1, wherein the aliphatic hydroxycarboxylic acid or its salt is citric acid, malic acid or gluconic acid, or its sodium, ammonium, cyclohexylamine or morpholine salt.

6. The composition as claimed in claim 1, wherein the aliphatic dicarboxylic acid or its salt is glutaric acid, succinic acid, or adipic acid, or its sodium, ammonium, cyclohexylamine, or morpholine salt.

7. The composition as claimed in claim 1, wherein the homopolymer and the copolymer as a water-soluble polymer component have a molecular weight in the range of 500 to 20,000.

8. The composition as claimed in claim 1, wherein the weight ratio of (a):(b):(c):(d) is 1:0.5–10:0.1–1.5:0.2–1.6.

9. A method for inhibiting the corrosion of ferrous metals in a water system comprising adding to the water system a composition comprising
(a) one or more inorganic acid components of molybdic acid or its alkali salt, tungstic acid or its alkali salt, or alkali salt of nitrous acid;
(b) an aliphatic hydroxycarboxylic acid or aliphatic dicarboxylic acid having up to seven carbon atoms or salt thereof;
(c) an inorganic heavy metal compound selected from the group consisting of the sulfate, the chloride, the nitrate and the sulfanate of zinc, manganese, tin, and, nickel, and mixtures thereof, which can readily release a heavy metal ion in water; and
(d) a water-soluble polymer component having a molecular weight in the range of 500 to 100,000 of a homo- or copolymer of acrylic acid, methacrylic acid or maleic acid; or a copolymer of any of said three monomers with other copolymerizable compounds having an ethylenic double bond; or a mixture of said homopolymer and copolymer, in a total concentration of said four components of 1 to 200 ppm; the weight ratio of components a:b:c:d being about 1:0.2–30:0.1–5:0.1–5.

10. The method according to claim 9, wherein the components (a), (b), (c) and (d) are individually added to the water system.

* * * * *